United States Patent [19]

Kaneko et al.

[11] Patent Number: 4,601,327

[45] Date of Patent: Jul. 22, 1986

[54] HORIZONTAL CONTINUOUS CASTING INSTALLATION

[75] Inventors: Hideo Kaneko; Hatuyoshi Kumashiro; Akira Iwata, all of Kobe, Japan

[73] Assignee: Kawasaki Jukogyo Kabushiki Kaisha, Kobe, Japan

[21] Appl. No.: 388,399

[22] Filed: Jun. 14, 1982

[30] Foreign Application Priority Data

Jun. 17, 1981 [JP] Japan ..... 56-94333

[51] Int. Cl.[4] ..... B22D 11/00; B22D 27/02

[52] U.S. Cl. ..... 164/502; 164/440; 164/466

[58] Field of Search ..... 164/466, 467, 488, 490, 164/502, 505, 440, 439

[56] References Cited

U.S. PATENT DOCUMENTS 3,630,266 12/1971 Watts ..... 164/490 X
3,987,840 10/1976 Birat ..... 164/490 X
4,146,078 3/1979 Rummel et al. ..... 164/467
4,450,892 5/1984 Heinemann et al. ..... 164/472 X

FOREIGN PATENT DOCUMENTS 47-15332 8/1972 Japan .
50-27448 9/1975 Japan .

*Primary Examiner*—Nicholas P. Godici
*Assistant Examiner*—J. Reed Batten, Jr.
*Attorney, Agent, or Firm*—Jordan and Hamburg

[57] ABSTRACT

A horizontal continuous casting installation wherein a body of molten metal stored in a tundish is continuously fed through a tundish nozzle connected to the tundish near its bottom and extending horizontally to a mold connected to the forward end of the tundish nozzle coaxially therewith, to perform casting by the mold to produce a strand continuously withdrawn horizontally from the mold. An electromagnetic field generating device is arranged in the vicinity of the tundish nozzle and mold in a manner to enclose same, to generate an electromagnetic force oriented toward the center of a body of molten metal flowing through the boundary and exerted on the body of molten metal. The electromagnetic field generating device is constructed such that a magnetic flux of higher density is generated in a lower portion of the body of molten metal than in an upper portion thereof.

1 Claim, 17 Drawing Figures

HORIZONTAL CONTINUOUS CASTING INSTALLATION

This invention relates to a horizontal continuous casting installation for continuously feeding molten metal stored in a tundish through a tundish nozzle secured horizontally to a side wall of the tundish in the vicinity of its bottom to a mold connected to the forward end of the tundish nozzle and arranged coaxially therewith to thereby cast the molten metal in the mold and continuously withdraw from the mold a strand formed therein.

BACKGROUND OF THE INVENTION

Heretofore, a horizontal continuous casting installation of the aforesaid construction has been constructed such that the tundish nozzle and the mold are intimately connected to each other to keep a body of molten metal from leaking between the tundish nozzle formed of refractory material and the mold cooled with water. Because of this, the cooled molten metal has tended to form a shell of solidified molten metal on the outer side of the body of molten metal in the vicinity of the tundish nozzle adjacent the water-cooled mold as the molten metal begins to solidify at its outer side and become adhered to the tundish nozzle. Also, the molten metal has tended to invade the refractory material through the pores and become solidified therein, to thereby increase bond strength between the shell and the tundish nozzle. When this is the case, the shell formed by solidification of the molten metal undergoes rupture when the strand is withdrawn to thereby give rise to what is generally referred to as a break-out.

PRIOR ART STATEMENT

To obviate this problem, proposals have hitherto been made to provide a non-porous ring formed of silicon nitride or boron nitride having excellent lubricating function between the tundish nozzle and the mold to airtightly connect them together. However, rings formed of silicon nitride or boron nitride are short in service life and expensive. Although adhesion of a shell of solidified molten metal to the tundish nozzle may be avoided to a certain degree by using such rings, it has been impossible to completely avoid adhesion of the shell of solidified molten metal to the tundish nozzle. Under these circumstances, it has been necessary, as described in Japanese Patent Application Laid-Open No. Sho-47-15332, to carry out withdrawing of a strand intermittently, not continuously. It would have effect in preventing adhesion of the shell of solidified molten metal to the tundish nozzle or mold to cause the mold to vibrate back and forth with respect to a direction in which the strand is withdrawn. However, in view of the fact that the tundish nozzle and the mold are intimately connected together as aforesaid, it has been impossible to obtain vibration of the mold as desired.

OBJECTS AND SUMMARY OF THE INVENTION

This invention has as for one of its objects the provision of a horizontal continuous casting installation which, in view of the aforesaid problems encountered by horizontal continuous casting installations of the prior art, is capable of preventing a shell of solidified molten metal from adhering to the tundish nozzle by avoiding contact between the molten metal and an inner surface of the tundish nozzle in portion of the tundish nozzle near the mold, to thereby enable a strand to be withdrawn continuously from the mold.

The aforesaid object can be accomplished according to the invention by providing the horizontal continuous casting installation with electromagnetic field generating means enclosing the tundish nozzle and the mold in the vicinity of the boundary therebetween for exerting an electromagnetic force directed to the center line of a body of molten metal flowing through the vicinity of the boundary between the tundish nozzle and the mold on such body of molten metal in such a manner that the electromagnetic force has its intensity increased in going from an upper portion of the body of molten metal toward a lower portion thereof.

Another object is to provide a horizonal continuous casting installation in which the mold can be made to vibrate back and forth with respect to a direction in which a strand is withdrawn from the mold.

DISCLOSURE OF PREFERRED EMBODIMENTS

Figure 1:
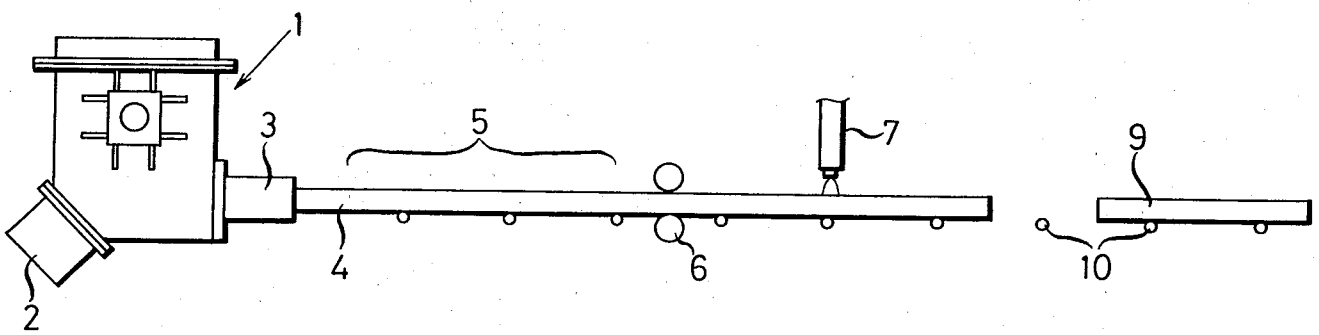
FIG. 1 is a side view of one example of horizontal continuous casting apparatus of the prior art, showing the construction of the installation in its entirety.

FIG. 1 shows one example of horizontal continuous casting installation of the prior art for producing steel ingots, showing the construction of the installation as a whole. As shown, a tundish 1 has a heating device 2 for stabilizing the temperature of a body of molten steel in the tundish 1. A strand 4 cast in a mold 3 and released therefrom is withdrawn from a withdrawing zone 5 by a withdrawing device 6 and cut by a cutting device 7 to provide an ingot 9. The ingot 9 is transferred by a roller table 10.

Figure 2:
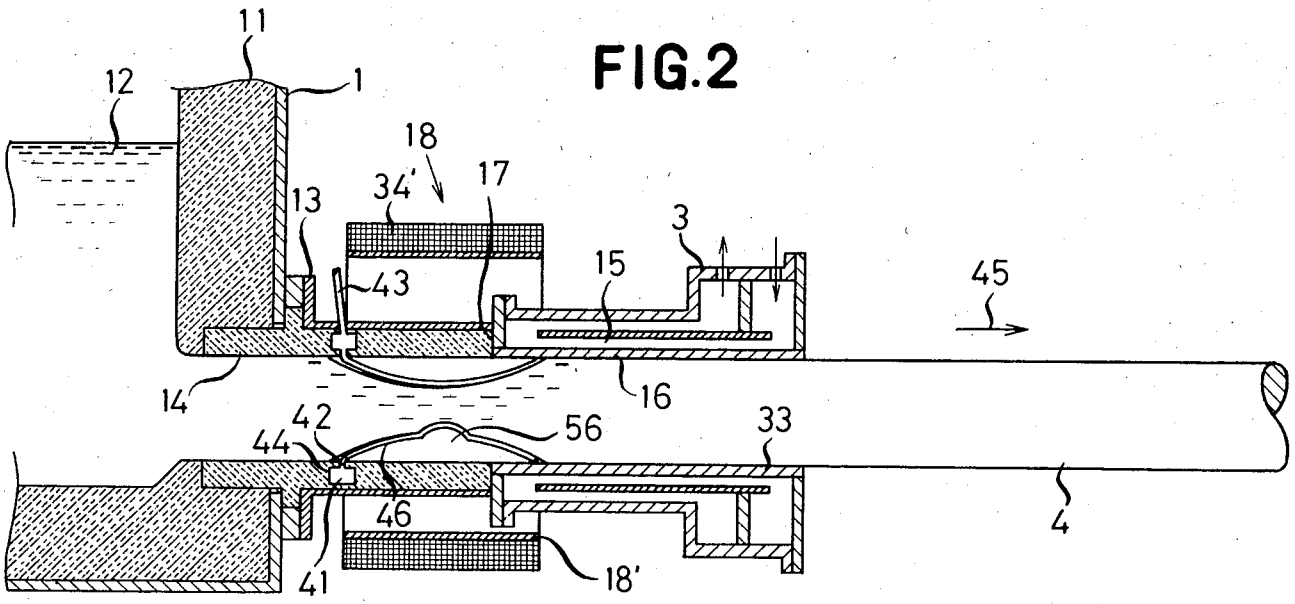
FIG. 2 is a vertical sectional view of the horizontal continuous casting installation according to one embodiment of the invention, showing a portion of the installation in the vicinity of the tundish nozzle and the mold.

FIG. 2 is a sectional view of an embodiment of the invention incorporated in the installation shown in FIG. 1, showing, on an enlarged scale, a portion of the installation in the vicinity of a tundish nozzle 14 and the mold 3. The tundish 1 has a lining of refractory material 11 and stores a body of molten metal 12. The tundish 1 has secured thereto a tundish nozzle 14 formed of refractory material connected thereto by a mounting member 13. The mold 3 has a cooling liquid passage 15 for achieving water cooling of a mold tube 33 formed of copper, and a strand passage 16 coaxially connected to the tundish nozzle 14 to allow the strand 4 to move therethrough. The mold 3 is firmly secured to the tundish nozzle 14.

Electromagnetic field generating means 18 is located in the vicinity of a boundary 17 between the tundish nozzle 14 and the mold 3 and comprises a first coil 34 and a second coil 35 enclosing the vicinity of the boundary 17 and energized by an AC power. A body of molten steel flowing through the vicinity of the boundary 17 has its transverse dimension reduced or is converged in going from its upstream side toward its downstream side by electromagnetic field generated by the electromagnetic field generating means 18, as subsequently to be described in detail by referring to FIG. 3. Thus, it is possible to prevent the molten steel from coming into contact with a portion of the tundish nozzle 14 close to the mold 3 in the vicinity of the boundary 17, to thereby keep a shell of solidified molten steel from adhering to the tundish nozzle 14 and enable the strand 4 to be continuously withdrawn from the mold 2.

The two coils 34 and 35 constituting the electromagnetic field generating means 18 each comprises a wire wound such that its convolutions enclose the tundish nozzle 14 and a portion of the mold 3 and radially spaced apart from one another.

Figure 3:
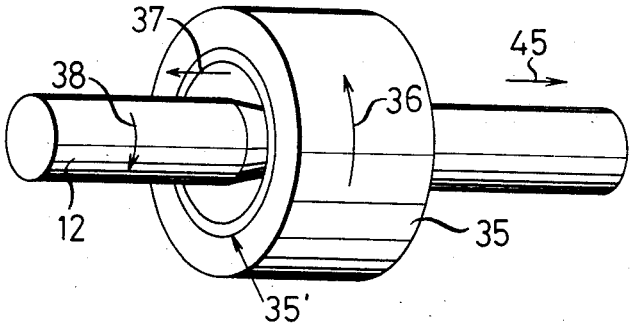
FIG. 3 is a schematic view in explanation of the principle of a reduction in the transverse dimention of a body of molten metal.

Referring to FIG. 3, when an energizing current flows in the direction of an arrow 36 through the wire of the second coil 35, a magnetic field is generated in the direction of an arrow 37. When the energizing current is increased in value along a curve 61 shown in FIG. 3*a* (1), an eddy current 38 flows in the direction of an arrow 38 opposite the direction of the energizing current of the arrow 36 in the molten metal 12. Thus according to the Fleming's left-hand rule, an electromagnetic force directed to the central portion is exerted on the molten metal 12.

Meanwhile when the energizing current is reduced along a curve 62 shown in FIG. 3 (1), the eddy current 38 flows in the opposite direction and exerts a diverging force on the molten steel. To keep the diverging force from being exerted on the molten steel, it has hitherto been usual practice to distort the wave form of an energizing AC current which is generally a sine wave, as shown in FIG. 3 (1) to increase the changing rate of the energizing current only in the region of the curve 62. When the energizing current is given with this wave form, it is possible to absorb the component of the region of the curve 62 by forming a bobbin 35' of the coil 35 or the tundish nozzle mounting member 13 shown in FIG. 2 of copper of low electric resistivity, for example. As a result, a converging force is exerted on the body of molten steel as measured by a mean time of one cycle, as shown in FIG. 3*a* (2).

Figure 3A:
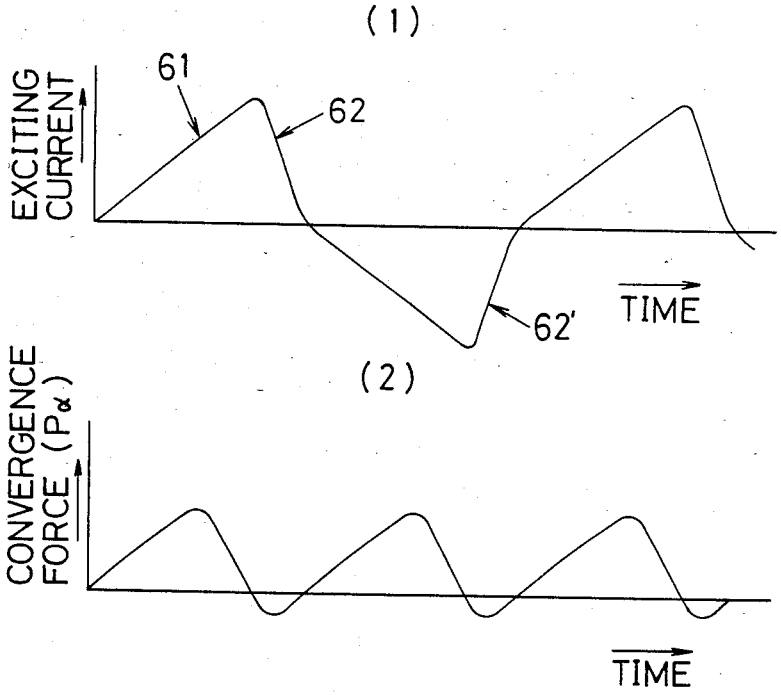
FIG. 3*a* is a graph showing the relation between the energizing current and the throttling force.

In FIG. 3*a* (1), an induced current flows on the surface of the body of molten steel in a direction opposite the direction indicated by an arrow 38 in a region in which the energizing current flows along curves 62 and 62', so that a negative converging force is exerted thereon. In the region of the curves 62 and 62' in which changes in the current value are great, the greater the changes in the value of the energizing current, the more readily absorbed is the induced current by the molten steel or a mold wall. Thus, if the region of the curves 62 and 62' shown in FIG. 3*a* (1) has its length reduced, the need to use an induced current absorbing plate 18' arranged inwardly of the electromagnetic field generating means 18 can be eliminated. The induced current absorbing plate 18' is intended to positively absorb the induced current in the region of the curves 62 and 62'.

Thus the body of molten steel 12 has its transverse dimention reduced in the vicinity of the boundary 17. The aforesaid description regarding the second coil 35 also applies to the first coil 34.

Figure 4:
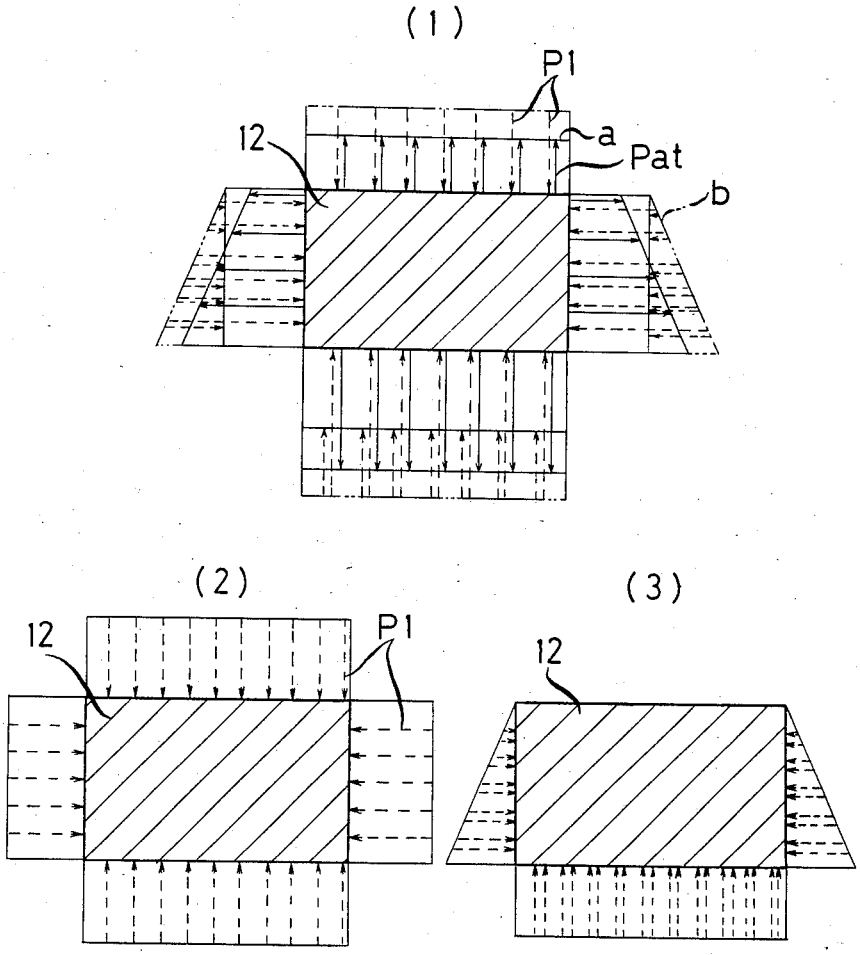
FIG. 4 is a schematic view in explanation of a converging force acting on the body of molten metal to have its transverse dimension reduced.

FIG. 4 shows the distribution of static pressure acting on the body of molten metal 12 flowing through the tundish nozzle 14 and mold 12 and the distributions of a static pressure compensating force and a converging force exerted by the first coil 34 and second coil 35 on the surface of the body of molten steel. When the tundish nozzle 14 and mold 3 are rectangular in a cross section taken at right angles to their axes, the distribution of static pressure Pat exerted by the body of molten metal in the vicinity of the boundary 17 between the tundish nozzle 14 and mold 3 is indicated by a line a shown in FIG. 4 (1). The distribution of the static pressure compensating force exerted on the surface layer of the body of molten metal is indicated by a line b shown in FIG. 4 (1). The first coil 34 generates a static pressure compensating magnetic force shown in FIG. 4(*a*). The static pressure compensating force P1 shown in FIG. 4 (2) is a total of static pressure Pat and a converging force P$\alpha$ exerted on the surface of the upper layer of the body of molten steel. The first coil 34 has an axis which coincides with those of the tundish nozzle 14 and mold 3. To compensate for an unbalance of static pressure shown in FIG. 4 (3), the second coil 35 is arranged such that the axis of the coil is located above those of the tundish nozzle 14 and mold 3. Thus the magnetic flux density generated in the body of molten metal 12 in the vicinity of the boundary 17 is higher in a lower portion than in an upper portion.

Figure 5:
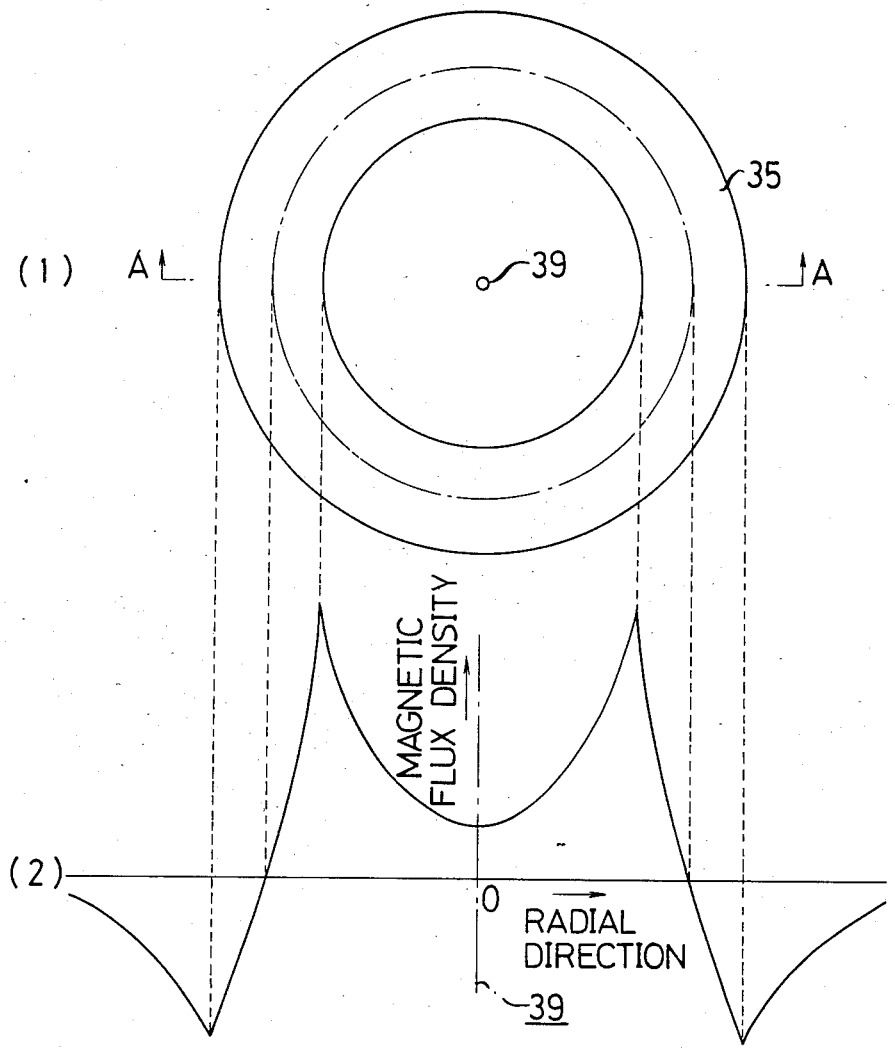
FIG. 5 is a schematic view of one example of the magnetic flux density distribution of a coil.

The function of the second coil 35 will be described by referring to FIG. 5. FIG. 5 (1) is a front view of the second coil 35 as viewed axially thereof, and FIG. 5 (2) shows the distribution of a magnetic flux density in a cross section taken along the line A—A extending through the axis 39 of the second coil 35. In this cross section, it will be seen that the magnetic flux density within the second coil 35 becomes larger in going radially outwardly of the second coil 35. According to the invention, the axis 39 of the second coil 35 is located above those of the tundish nozzle 14 and mold, so that the electromagnetic force exerted on the lower layer of the body of molten metal 12 is higher than that exerted on the upper layer thereof. Thus an electromagnetic force counteracting the force of gravity as shown in FIG. 4 (2) acts on the body of molten metal 12 to thereby compensate for the force of gravity.

The mold 3 is formed with the strand passage 16 having a transverse dimension which becomes smaller in going toward the direction in which the strand 4 is withdrawn from the mold to conform to the contraction of the strand 4 taking place as its solidification progresses, to render cooling of the strand 4 in the mold 3 uniform.

Referring to FIG. 2 again, means for supplying lubricant will be described. The tundish nozzle 14 formed with an annular header 41 formed with a nozzle 42 directed radially inwardly of the tundish nozzle 14. A lubricant 46 is supplied under pressure to the header 41 through a conduit 43. The nozzle 42 is located anterior to a position 44 in which the molten metal 12 is released from the tundish nozzle 14, with respect to a direction 45 in which the strand 4 is withdrawn from the mold 3. The lubricant 46 contains as its main ingredient CaO, $SiO_2$ or $Al_2O_3$ in powder form added with pure iron and cobalt powders which have good electric conductivity. When the lubricant 46 contains the aforesaid powder, the electromagnetic force directed radially inwardly of the tundish nozzle 14 and mold 3 acts on the powder, to allow the lubricant 46 to be positively deposited on the entire outer peripheral surface of the body of molten metal 12 that has been converged in going toward the direction in which the strand 4 is withdrawn from the mold 3, thereby improving the lubricating function of the portion of the body of molten metal 12 that is first brought into contact with the strand passage 16 in the mold 3. The lubricant 46 may contain as its main ingredient rapeseed oil added with pure iron and cobalt powders.

Figure 2A:
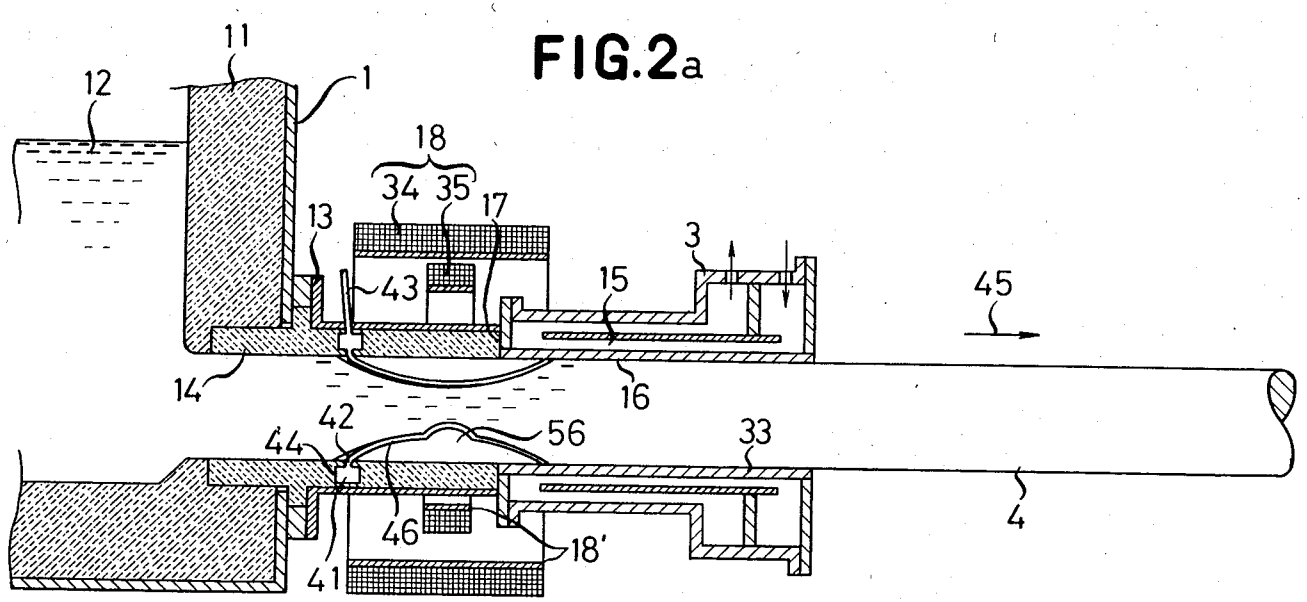
FIG. 2*a* is a view similar to FIG. 2 but showing a horizontal continuous casting installation according to another embodiment.

In the embodiment shown in FIG. 2*a*, a combination of two coils is used for positively effecting compensation for static pressure. However, as shown in FIG. 2, a single coil 34' which is located in eccentric relation to the strand 4 as is the case with the second coil 35 shown in FIG. 2*a* may be used with more or less the same effects achieved.

Figure 6:
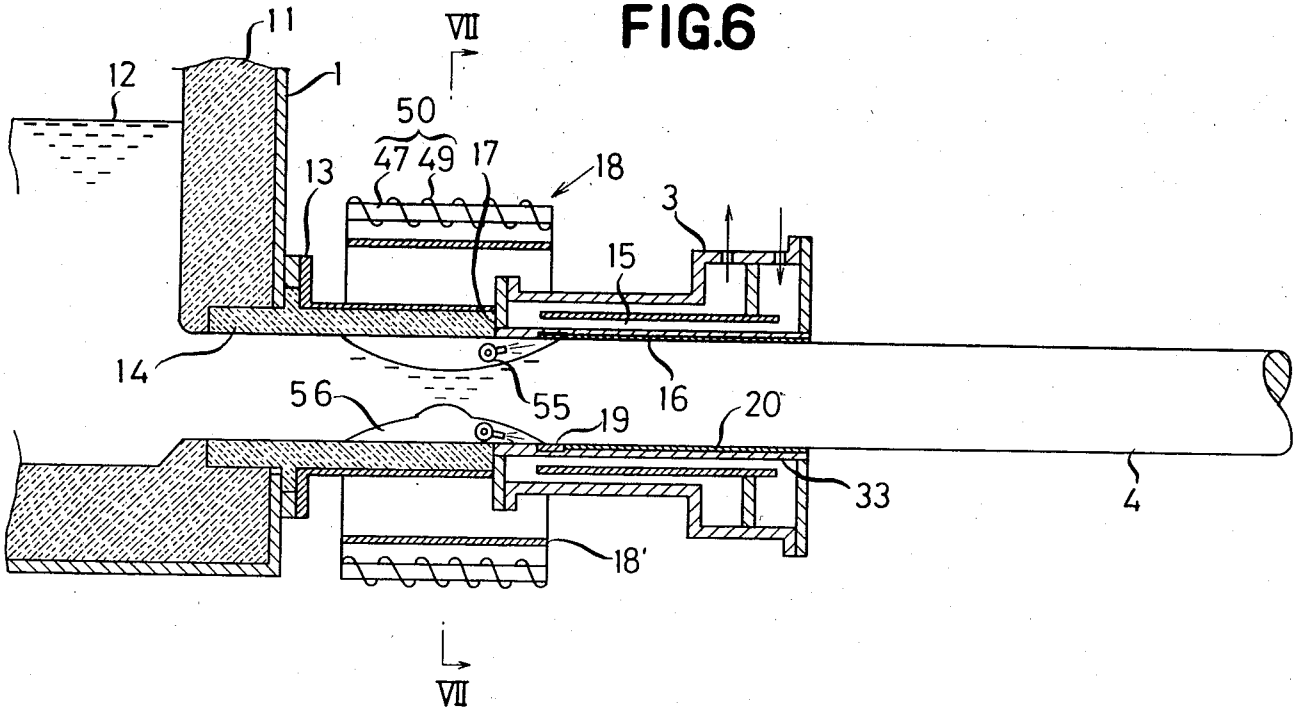
FIG. 6 is a vertical sectional view of the horizontal continuous casting installation according to a further embodiment.
Figure 7:
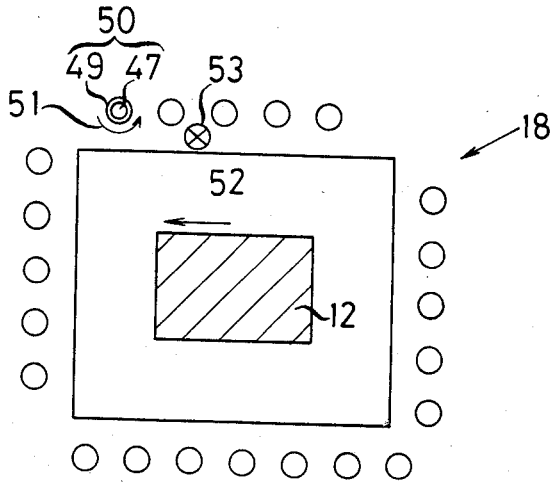
FIG. 7 is a sectional view taken along the line VII—VII in FIG. 6.

FIGS. 6 and 7 show another embodiment which is substantially similar to the embodiment shown and described hereinabove and in which parts similar to those shown in FIGS. 1–5 are designated by like reference characters. The electromagnetic field generating means 18 comprises a plurality of electromagnetic field generating elements 50 each including a rod-shaped core 47 extending axially of the tundish nozzle 14 and mold 3 and a coil 49 wound thereon and arranged on an imaginary cylindrical surface surrounding the tundish nozzle 14 and mold 3. The electromagnetic field generating elements 50 are arranged closer to one another in the lower portion of the body of molten metal 12 than in its upper portion thereof, so that a magnetic flux of higher density is imparted to the lower portion of the body of molten metal 12 than to the upper portion thereof. By causing a current to flow through the coils 49 in the direction of an arrow 51, an eddy current is generated in the body of molten metal 12 and flows in the direction of an arrow 52. The magnetic field generated by the electromagnetic field generating elements 50 is oriented in a direction indicated by an arrow 53. Thus an electromagnetic force tending to act radially inwardly of the body of molten metal 12 has a converging effect on the body of molten metal 12. As described hereinabove, since the electromagnetic field generating elements 50 are arranged at a higher density in the lower portion of the body of molten metal 12 than in the upper portion thereof, it is possible to satisfactorily effect compensation for the static pressure on the body of molten metal 12.

In this embodiment, lubricant, such as rapeseed oil, is applied by spraying through nozzles 55 to a portion of the body of molten metal 12 of reduced transverse dimension that is first brought into contact with the wall of the strand passage 16. However, the invention is not limited to this manner of applying the lubricant and the lubricant may, of course, be applied in the same manner as described by referring to FIG. 2. The nozzles 55 are arranged annularly in a clearance 56 peripherally thereof between the body of molten metal 12 of reduced transverse dimension and the wall of the strand passage 16.

Figure 8:
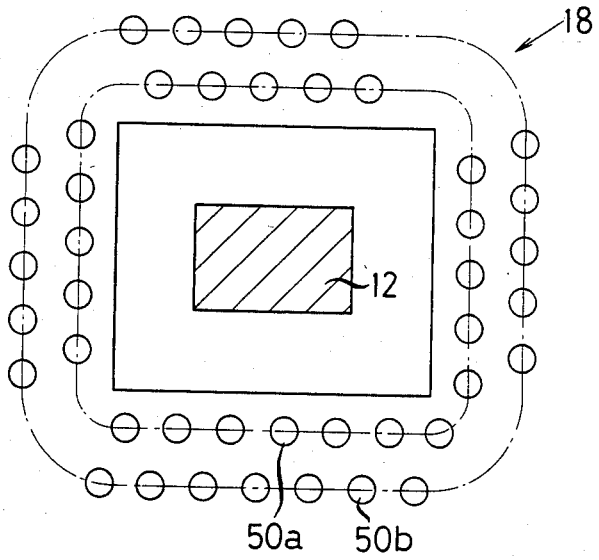

FIG. 8 shows, in a sectional view similar to FIG. 7, another embodiment of the invention in which the electromagnetic field generating elements 50 are arranged in a plurality of layers (two layers in this embodiment). The numeral 50*a* designates the first layer of electromagnetic field generating elements located radially inwardly, and the numeral 50*b* designates the second layer thereof located outwardly. Attention is directed to the arrangement whereby the electromagnetic field generating elements 50*a* of the first layer are displaced peripherally with respect to the electromagnetic field generating elements 50*b* of the second layer.

Figure 9:
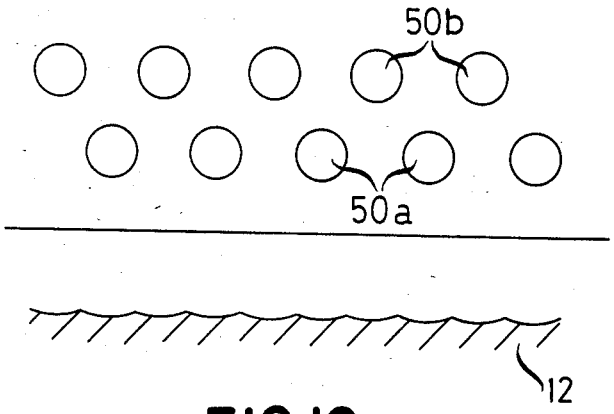
FIG. 9 is a sectional view, on an enlarged scale, of portion of the modification of the embodiment shown in FIG. 8.

FIG. 9 is a sectional view showing, on an enlarged scale, a portion of the embodiment shown in FIG. 8. By virtue of the feature that the electromagnetic field generating elements 50*a* and 50*b* of the first and second layers are peripherally displaced from each other, the body of molten metal 12 has a smooth surface and no large irregularities are formed peripherally thereof. This makes it possible to deposit the lubricant 46 uniformly on the outer peripheral surface of the body of molten metal 12.

Figure 7A:
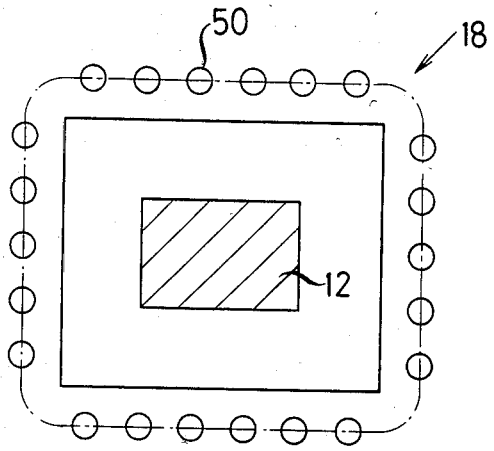
FIGS. 7*a*, 7*b* and 8 are sectional views of modification of the embodiment shown in FIG. 7.
Figure 7B:
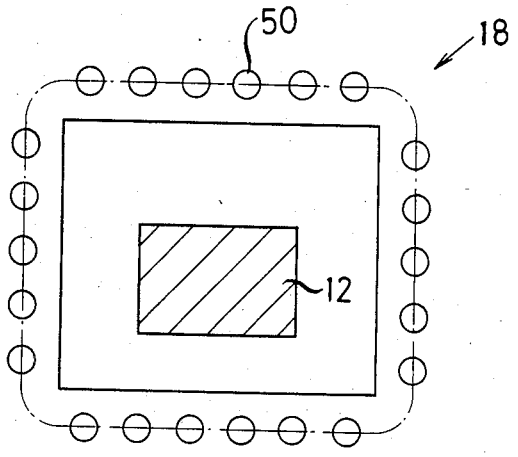

To increase the magnetic flux density in the lower portion of the body of molten metal 12 as compared with that in the upper portion thereof, the electromagnetic field generating elements 50 may be arranged equidistantly from one another along the periphery of the body of molten metal 12 as shown in FIG. 7*a* to supply a current of higher value through the lower coils than through the upper coils, or the electromagnetic field generating elements 50 may be arranged equidistantly from one another on an imaginary cylindrical surface as shown in FIG. 7*b* in such a manner that the imaginary cylindrical surface has an axis displaced upwardly from those of the tundish nozzle 14 and mold 3.

Figure 10:
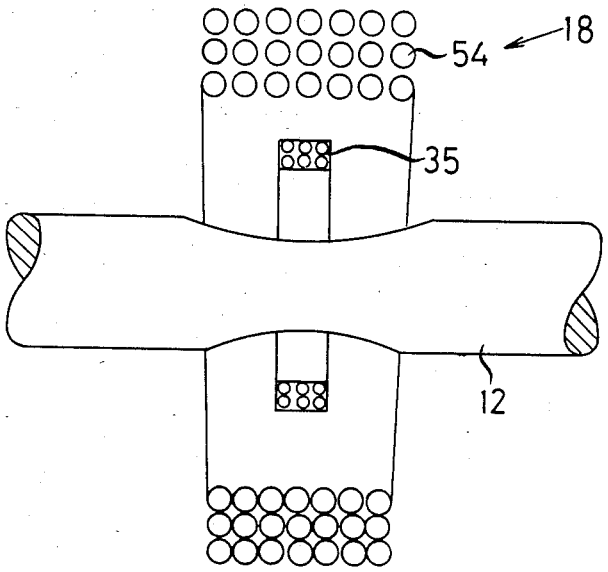
FIG. 10 is a sectional view of the horizontal continuous casting installation according to a still further embodiment.

FIG. 10 is a theoretical sectional view of still another embodiment comprising coils 54 each having a wire wound around the axes of the tundish nozzle 14 and mold 3. Each coil 54 has a smaller length as measured axially of the tundish nozzle 14 and mold 3 in its lower portion than in its upper portion, to thereby increase the density of convolutions of the wire, to thereby give a higher density of magnetic flux to the lower portion of the body of molten metal 12 than to the upper portion thereof. Thus static pressure compensation can be effected with increased positiveness for the molten metal 12. In this embodiment, the second coil 35 is displaced with respect to the tundish nozzle 14 and mold 3 and arranged in the same manner as described by referring to the embodiment shown and described hereinabove.

Figure 11:
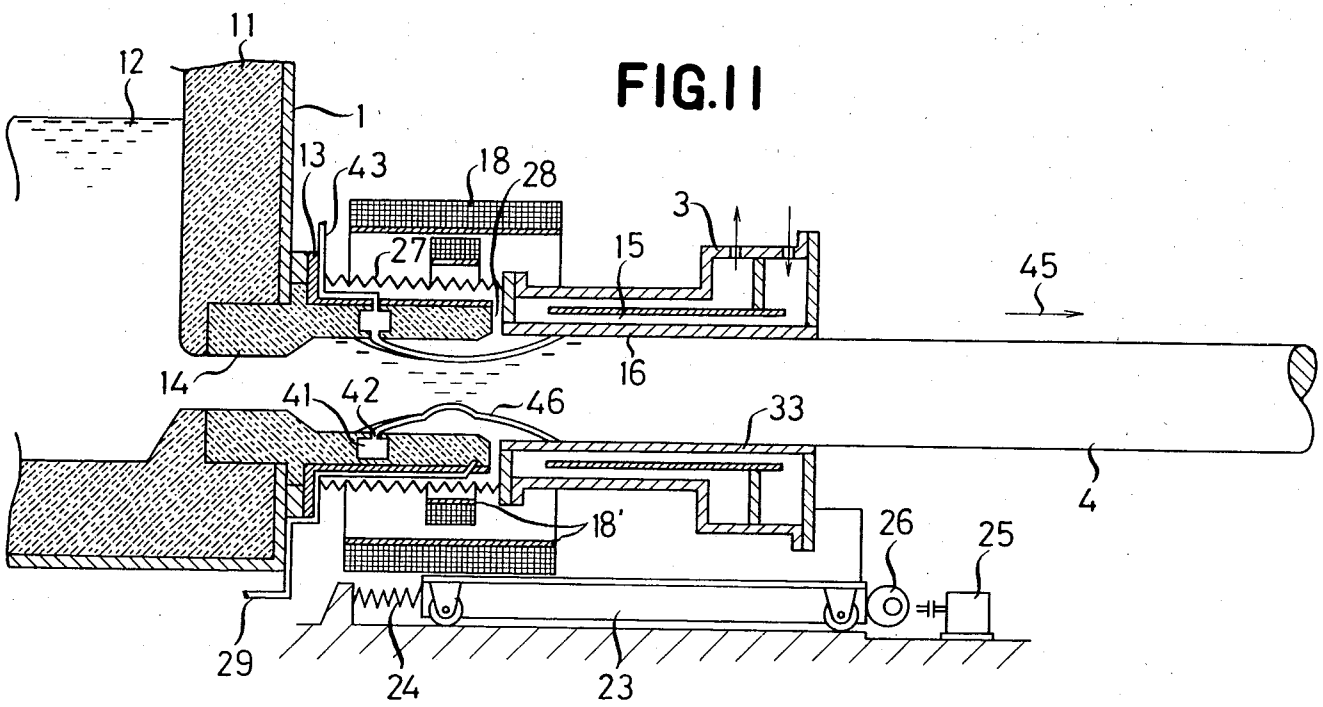
FIG. 11 is a vertical sectional view of the horizontal continuous casting installation according to another embodiment.
Figure 12:
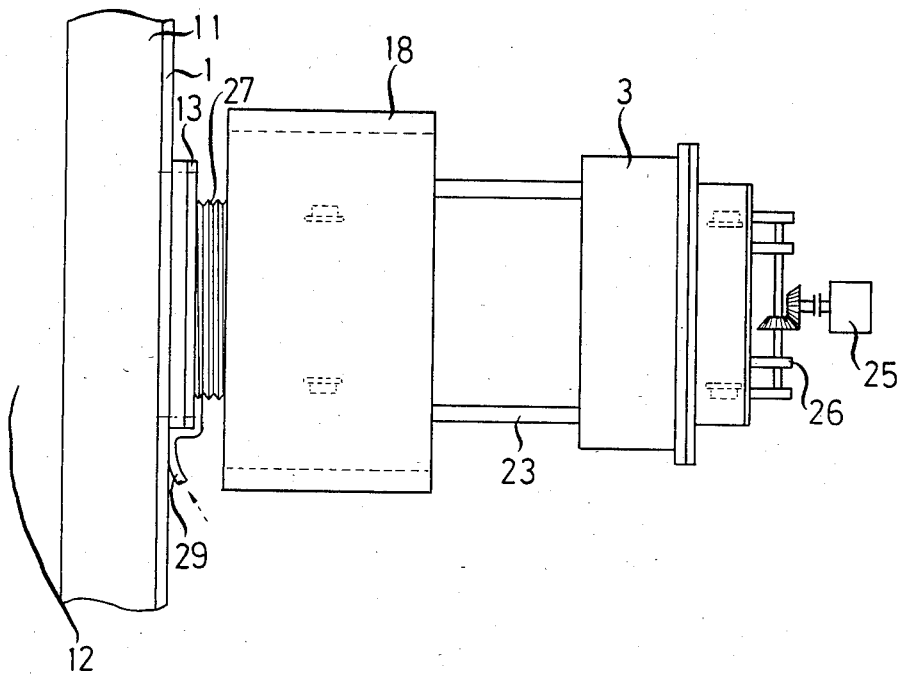
FIG. 12 is a plan view of the embodiment shown in FIG. 11.

FIG. 11 is a vertical sectional view of still another embodiment, and FIG. 12 is a top plan view of the embodiment shown in FIG. 11. In FIGS. 11 and 12, parts similar to those shown in FIGS. 1–10 are designated by like reference characters. It is noteworthy to remark in this embodiment that the mold 3 is supported on a truck 23 movable reciprocatingly with respect to the direction 45 in which the strand 4 is withdrawn from the mold 3. The truck 23 is urged by the biasing force of a compression spring 24 to move in the direction 45 and moved back and forth relatively to the strand withdrawing direction 45 by an eccentric cam 26 driven by a motor 25 to move in vibratory movement. The truck 23 also supports thereon the electromagnetic field generating means 18. The lubricant 46 is fed through the nozzles 42 to the body of molten metal 12 of reduced transverse dimension to be deposited on the entire outer peripheral surface thereof, to thereby positively effect lubrication of the body of molten metal 12 and avoid oxidation thereof.

In this embodiment, the mold 3 and the tundish nozzle 14 are spaced apart from each other by a clearance 28 to move the mold 3 back and forth in vibratory movement with respect to the direction 45 in which the strand 4 is withdrawn from the mold 3. This is conducive to prevention of adhesion of a shell of solidified molten metal to the tundish nozzle 14 and mold 3 and rapid cooling of the strand 4, thereby enabling continuous withdrawing of the strand 4 to be effected smoothly. The tundish nozzle 14 has a greater transverse dimension on a side thereof adjacent the mold 3 than on a side thereof adjacent the tundish 1. By this arrangement, any shell of solidified molten metal that might adhere to the tundish nozzle 14 can be readily separated and withdrawn from the tundish nozzle.

When the nozzle 55 shown in FIG. 6 are used in place of the nozzles 42, airtightly sealing means 27, such as a bellows of flexibility, may be used to provide an airtight seal to the clearance 28 between the tundish nozzle 14 and mold 3, to keep the surface of the body of molten metal 12 of reduced transverse dimension from being oxidized. Inert gas, such as argon, nitrogen, etc., may be supplied through a conduit 29 to the interior of the airtightly sealing means 27.

Figure 13:
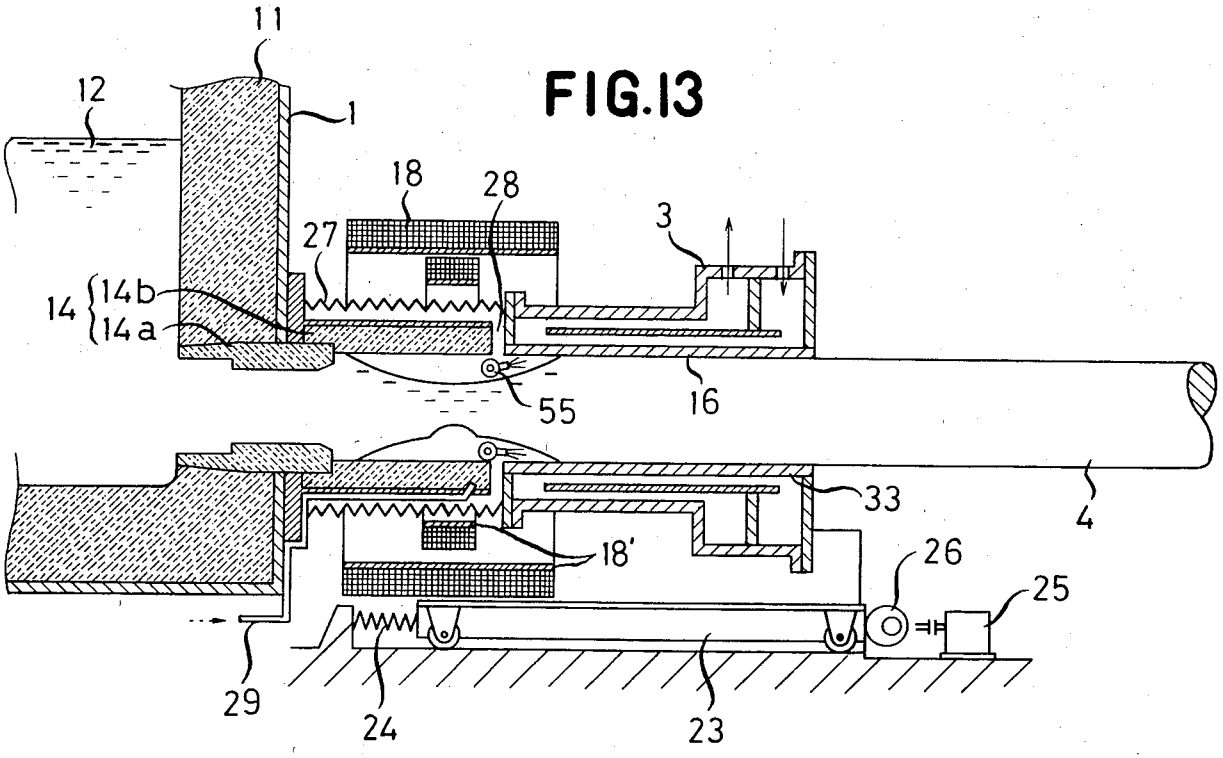
FIG. 13 is a vertical sectional view of the horizontal continuous casting installation according to a still further embodiment.

FIG. 13 shows further embodiment, in cross section, in which the tundish nozzle 14 is composed of a plurality of portions 14*a* and 14*b*, to thereby facilitate fabrication of the tundish nozzle 14 of large cross section or complicated cross section. Other parts of the embodiment shown in FIG. 13 are similar to those of embodiments shown in FIGS. 1–12.

In the embodiment shown in FIGS. 11–13, the electromagnetic field generating means 18 is supported on the truck 23 and moved in vibratory movement together with the mold 3 as a unit. However, this is not essential and the electromagnetic field generating means 18 may be securedly fixed without being moved. In the embodiment shown in FIGS. 11–13, the truck 23 is moved in vibratory movement by the eccentric cam 26, but the eccentric cam 26 may be replaced by a crank mechanism or a double acting hydraulic cylinder.

When the invention is incorporated in the prior art in which, as described in Japanese Pat. No. Sho-50-27448, a ring of boron nitride or silicon nitride is mounted in the tundish nozzle portion to carry out intermittent withdrawing of a strand from the mold, the invention has the effect of elongating the service lives of these rings. For lubricating a body of molten metal in the mold, lubricant in powder form has been described as being supplied to the body of molten metal in the vicinity of the position in which a reduction in the transverse dimension of the body of molten metal is initiated or lubricant has been described as being sprayed on to the body of molten metal in a portion thereof which is first brought into contact with the wall of the mold. Besides the processes described above, a protective layer 19 formed of non-porous boron nitride or silicon nitride of high lubricating function may be mounted in the strand passage 16 of the mold 3 in the vicinty of the boundary 17 in which the body of molten metal 12 of reduced transverse direction is first brought into contact with the wall of the passage 16, and another protective layer 20 formed of carbon and having high lubricating function may be mounted downstream of the protective layer 19 with respect to the strand withdrawing direction, as shown in FIG. 6. This is conducive to prevention of adhesion of a shell of solidified molten metal to the wall of the strand passage 16 of the mold 3, thereby permitting the strand 4 to be smoothly and continuously withdrawn from the mold 3.

By controlling the magnetic field generating force of the electromagnetic field generating means 18 or moving the position in which the generating means 18 is located, it is possible to interrupt the flow of the body of molten metal 12 in the tundish 1 into the mold 3.

It is to be understood that the invention can have application not only to steel but also to any metal in molten state to cast same over a wide range so long as the metal has electric conductivity.

From the foregoing description, it will be appreciated that according to the invention, electromagnetic field generating means is used for exerting a converging force on a body of molten metal to reduce its transverse dimension in the vicinity of the boundary between the tundish nozzle and mold, to avoid contact of the body of the molten metal with the tundish nozzle and keep a shell of solidified molten metal from adhering to the tundish nozzle. This is conducive to prevention of wear that might otherwise be caused on the tundish nozzle. The invention thus enables a horizontal continuous casting installation to carry out continuous withdrawing of a strand without any trouble. In the invention, the mold may be moved in vibratory movement back and forth with respect to the direction in which the strand is withdrawn from the mold. By virtue of this feature, cooling of the strand can be achieved with increased speed and the strand can be withdrawn at increased speed. The electromagnetic field generating means according to the invention is capable to generating a magnetic flux of higher density in a lower portion of a body of molten metal than in an upper portion thereof. By virtue of this feature, compensation for static pressure applied to the body of molten metal of reduced transverse dimension can be positively effected, and the body of molten metal can be allowed to flow with substantially the same cross-sectional configuration as the mold while its axis is kept substantially in agreement with the axis of the mold. This is conducive to improved quality of a strand produced by horizontal continuous casting. In the prior art, it has been necessary to obtain a high degree of concentricity between the tundish, tundish nozzle and mold to withdraw stably a body of molten metal having a shell of solidified metal at its outer periphery. The need to meet this requirement is lessened when the invention is utilized.

What is claimed is:

1. In a horizontal continuous casting installation comprising:

a tundish for storing a body of molten metal;

a tundish nozzle secured to said tundish near its bottom and extending horizontally therefrom;

a mold positioned at the forward end of said tundish nozzle for continuously receiving a supply of molten metal stored in said tundish to cast said body of molten metal into a strand adapted to be continuously withdrawn from said mold in a horizontal direction; and electromagnetic field generating means mounted to enclose the vicinity of the boundary between said tundish nozzle and said mold thereby to generate an electromagnetic force oriented toward the center axis of and exerted on said body of molten metal flowing through said boundary, the improvement wherein:

said electromagnetic field generating means comprises means for generating a magnetic flux of higher density in a lower portion of said body of molten metal than in an upper portion thereof;

said electromagnetic field generating means having coils comprising said electromagnetic field generating means and means energizing said coils with an energizing current having a wave form distorted with the variation in absolute current value thereof in the region where the absolute current value decreases being greater than in the region where it increases;

an electromagnetic force absorbing and conducting plate interposed between said coils and said molten metal;

and said coils being arranged in two layers spaced apart from said tundish nozzle and said mold in enclosing relation thereto, said two layers of coils comprising an outer coil arranged coaxially with a tundish nozzle and the mold, and an inner coil having an axis spaced upwardly from the axes of said tundish nozzle and mold, to thereby generate said magnetic flux of higher density in a lower portion of the body of molten metal than in an upper portion thereof.

* * * * *